US010228213B1

(12) United States Patent
Smith

(10) Patent No.: US 10,228,213 B1
(45) Date of Patent: Mar. 12, 2019

(54) RECOIL REDUCING STOCK SYSTEM

(71) Applicant: Vista Outdoor Operations LLC, Farmington, UT (US)

(72) Inventor: Paul N. Smith, Bozeman, MT (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/898,884

(22) Filed: Feb. 19, 2018

Related U.S. Application Data

(62) Division of application No. 14/996,972, filed on Jan. 15, 2016, now Pat. No. 9,927,206.

(60) Provisional application No. 62/104,549, filed on Jan. 16, 2015, provisional application No. 62/104,573, filed on Jan. 16, 2015.

(51) Int. Cl.
*F41C 23/08* (2006.01)
*F41C 23/18* (2006.01)
*F41C 23/16* (2006.01)

(52) U.S. Cl.
CPC ..... *F41C 23/08* (2013.01); *F41C 23/16* (2013.01); *F41C 23/18* (2013.01)

(58) Field of Classification Search
CPC ..... F41C 23/08; F41C 23/18; F41C 23/20
USPC ..... 42/74
See application file for complete search history.

(56) References Cited

U.S. PATENT DOCUMENTS 1,334,467 A 3/1920 Moller
1,351,141 A 8/1920 Thompson
1,842,528 A * 1/1932 Knight ..... F41C 23/08 42/74
1,964,649 A 6/1934 Stetson
2,731,753 A 1/1956 Mathieu
2,754,608 A 7/1956 Stieffel, Jr.
2,831,404 A 4/1958 Sampson et al.
3,001,312 A 9/1961 Campbell
3,039,222 A 6/1962 Hoge
3,105,411 A 10/1963 Browning
3,176,424 A 4/1965 Hoge
(Continued)

FOREIGN PATENT DOCUMENTS

EP 1122507 4/1991
EP 1657518 5/2006
EP 229306 B1 11/2012

OTHER PUBLICATIONS

Givology [online] "The World's Largest Selection of Gun Parts & Accessories for Sale" First Accessed on Nov. 20, 2013. Retrieved from the Internet: http://www.gunaccessories.com/RecoilBuffers (15 pgs.).

(Continued)

*Primary Examiner* — Stephen Johnson
(74) *Attorney, Agent, or Firm* — Christensen, Fonder, Dardi & Herbert PLLC

(57) ABSTRACT

A recoil reduction system for a firearm. In some embodiments, the recoil reduction system includes a biasing element and a butt pad assembly configured to deform substantially proportionate to each other during a recoil event. The biasing element and/or butt pad assembly may include a spring-type element or, alternatively, a dampening device. The butt pad assembly may include an open cell butt pad having a hardness that is substantially higher than conventional butt pads.

11 Claims, 5 Drawing Sheets

(56) References Cited

U.S. PATENT DOCUMENTS 3,208,180 A * 9/1965 Woodcock ..... F41C 23/08 42/74
3,209,482 A 10/1965 Kuzma et al.
3,233,354 A 2/1966 Ahearn
3,405,470 A 10/1968 Wesemann
3,492,749 A 2/1970 Vironda
3,609,903 A * 10/1971 Pachmayr ..... F41C 23/08 42/74
3,707,797 A 1/1973 Ruth
3,714,726 A 2/1973 Braun
3,754,344 A 8/1973 Spiliotis
4,112,605 A 9/1978 Staub
4,439,943 A 4/1984 Brakhage
H217 H 2/1987 Jorczak
4,663,877 A 5/1987 Bragg
4,769,937 A 9/1988 Gregory et al.
4,774,873 A 10/1988 Shoales
4,785,922 A 11/1988 Kiehart
4,867,038 A 9/1989 Metz
4,910,904 A 3/1990 Rose
4,956,932 A * 9/1990 Cupp ..... F41C 23/08 42/74
4,986,018 A 1/1991 McDonald, Jr.
5,031,348 A 7/1991 Carey
5,235,764 A 8/1993 Perazzi
5,305,539 A 4/1994 Von Kuster
5,343,649 A 9/1994 Petrovich
5,362,046 A 11/1994 Sims
5,375,360 A 12/1994 Vatterott
5,392,553 A 2/1995 Carey
5,410,833 A 5/1995 Paterson
5,513,730 A 5/1996 Petrovich et al.
D376,188 S 12/1996 Riecken
5,598,904 A 2/1997 Spyche, Jr.
5,634,289 A 6/1997 Wascher
5,669,168 A 9/1997 Perry
5,722,195 A 3/1998 Bentley et al.
5,726,377 A 3/1998 Harris et al.
5,827,992 A 10/1998 Harris et al.
5,909,002 A 6/1999 Atchisson
5,974,718 A 11/1999 Bentley et al.
5,979,098 A 11/1999 Griggs
6,164,002 A 12/2000 Troncoso
6,305,115 B1 10/2001 Cook
6,467,212 B1 10/2002 Apel
6,481,143 B2 11/2002 McCarthy
6,530,563 B1 3/2003 Miller et al.
6,560,911 B2 5/2003 Sharp
6,564,493 B1 5/2003 Forman
6,594,935 B2 7/2003 Beretta
6,637,141 B1 10/2003 Weatherby et al.
6,651,371 B2 11/2003 Fitzpatrick et al.
6,662,485 B2 12/2003 Kay
6,684,547 B2 2/2004 Poff, Jr.
6,688,031 B2 2/2004 Steele
6,732,466 B2 5/2004 Bentley
6,758,126 B1 7/2004 Houtsma
6,761,102 B2 7/2004 Giza
6,834,455 B2 12/2004 Burigana
6,834,456 B2 12/2004 Murello
6,848,351 B1 2/2005 Davies
6,874,267 B2 4/2005 Fitzpatrick et al.
6,889,461 B2 5/2005 Vignaroli et al.
6,976,333 B2 12/2005 Sims
7,025,052 B2 4/2006 Schavone
7,055,277 B2 6/2006 Sims
7,121,032 B2 10/2006 Daul et al.
7,124,529 B1 10/2006 Havelka, Jr.
7,131,367 B1 11/2006 Boerschig et al.
7,152,355 B2 12/2006 Fitzpatrick et al.
7,152,356 B2 12/2006 Sims
7,162,822 B1 1/2007 Heayn et al.
7,273,002 B1 9/2007 Rogers
7,380,487 B2 6/2008 Mantas
7,478,495 B1 1/2009 Alzamora et al.
7,493,845 B2 2/2009 Mantas
7,536,819 B2 5/2009 Popikow
7,581,954 B2 9/2009 Schavone
7,673,413 B2 3/2010 Bentley
7,681,351 B2 3/2010 Bucholtz et al.
7,775,150 B2 8/2010 Hochstrate et al.
7,793,453 B1 9/2010 Sewell, Jr. et al.
7,823,313 B2 11/2010 Faifer
7,827,722 B1 11/2010 Davies
7,849,626 B2 12/2010 Fluhr
7,877,917 B2 2/2011 Cinciu
7,926,216 B2 4/2011 Bentley
7,930,849 B2 4/2011 Abraham et al.
7,938,055 B2 5/2011 Hochstrate et al.
7,963,203 B1 6/2011 Davies
7,966,760 B2 6/2011 Fitzpatrick et al.
7,984,580 B1 7/2011 Giauque et al.
7,992,337 B2 8/2011 Ochoa
8,037,806 B2 10/2011 Davies
8,051,593 B2 11/2011 Vesligaj
8,074,391 B2 12/2011 Petrůj
8,117,958 B2 2/2012 Hochstrate et al.
8,127,483 B2 3/2012 Kincel
8,176,668 B2 5/2012 Simms et al.
8,176,835 B1 5/2012 Cottle
8,205,371 B1 6/2012 Cook et al.
8,286,382 B2 10/2012 Vesligaj
8,296,984 B2 10/2012 Kincel
8,296,986 B1 10/2012 Cook et al.
8,297,175 B1 10/2012 Davies
8,327,569 B2 12/2012 Kincel
8,341,868 B2 * 1/2013 Zusnnan ..... F41C 23/22 42/73
8,356,542 B2 1/2013 Cottle et al.
8,387,297 B2 3/2013 deBrun et al.
8,413,361 B2 4/2013 Quaedpeerds et al.
8,430,015 B2 4/2013 Faifer
8,434,252 B2 5/2013 Holmberg
8,448,562 B2 5/2013 Cottle
8,468,729 B1 6/2013 Sylvester
8,474,169 B2 7/2013 Cottle et al.
8,505,226 B2 8/2013 Vesligaj
8,505,433 B2 8/2013 Hochstrate et al.
8,555,541 B2 10/2013 Ingram
8,561,338 B2 10/2013 Chvala
8,607,687 B2 12/2013 Cottle
8,661,963 B2 3/2014 Patel
8,671,608 B2 3/2014 Vesligaj
8,677,664 B2 3/2014 Caravaggi et al.
8,677,669 B1 3/2014 Vesligaj
8,689,672 B2 4/2014 Cassels
8,707,850 B1 4/2014 Davies
8,720,099 B1 5/2014 Sisk
8,752,472 B1 6/2014 Lukman et al.
8,776,421 B1 7/2014 Vesligaj
8,782,941 B2 7/2014 Zusman
8,783,160 B2 7/2014 Hochstrate et al.
8,800,189 B2 8/2014 Fitzpatrick et al.
8,806,791 B2 8/2014 Cottle
8,815,138 B2 8/2014 Howe et al.
8,844,185 B2 9/2014 Jarboe
8,863,428 B2 10/2014 Vesligaj
8,904,692 B2 12/2014 Ballard
8,943,726 B2 2/2015 Kincel
8,950,098 B2 2/2015 Sims et al.
9,021,727 B2 5/2015 Butler
2005/0246931 A1 11/2005 Poff, Jr.
2007/0089347 A1 4/2007 Webber et al.
2010/0229444 A1 9/2010 Faifer
2010/0251587 A1 10/2010 Kincel
2011/0113666 A1 5/2011 Latimer
2011/0138668 A1 6/2011 Thomas
2011/0258900 A1 10/2011 Sims et al.
2012/0167432 A1 7/2012 Howe et al.
2013/0174461 A1 7/2013 Ballard

(56) References Cited

U.S. PATENT DOCUMENTS

| | | | |
|---|---|---|---|
| 2014/0165443 | A1 | 6/2014 | Johnston |
| 2014/0196336 | A1 | 7/2014 | Butler |

OTHER PUBLICATIONS

Recoil Systems [online] "The ISIS II Recoil reducer is the only unit of its kind and is manufactured in the UK. The unit was developed and patented in 2001 and has sold very successfully through out the world since" First Accessed on Nov. 20, 2013. Retrieved from the Internet: http://www.recoilsystems.com/principle.asp (2 pgs.).

* cited by examiner

RECOIL REDUCING STOCK SYSTEM

CROSS-REFERENCE TO RELATED APPLICATIONS

This application is a Divisional of U.S. application Ser. No. 14/996,972, filed Jan. 15, 2016, now U.S. Pat. No. 9,927,206, which claims the benefit of U.S. provisional patent application No. 62/104,549, filed Jan. 16, 2015, and U.S. provisional patent application No. 62/104,573, filed Jan. 16, 2015, the disclosures of which are hereby incorporated by reference herein in their entirety.

BACKGROUND

Recoil abatement systems are commonly employed in firearms, ranging from compliant butt pads to spring-loaded or shock dampening components coupled to the buttstock. More recent recoil abatement systems include "sliding stock" systems, featuring components internal to the buttstock that enable enables the receiver of the firearm to translate within the buttstock. Some stock systems, irrespective of whether they provide recoil abatement, feature the ability to readily adjust the overall length.

Conventional sliding stock systems can be limited in the amount of relative translation between the receiver and the buttstock, causing the buttstock to abruptly jolt the operator at the end of the recoil stroke.

In view of this shortcoming, improvements to sliding stock systems would be welcomed.

SUMMARY

Recoil reduction system concepts are disclosed that may be utilized with a variety of firearms, such as shot guns and rifles. In some embodiments, the recoil reduction systems are provided as retrofit kits for installation on existing firearms. In other embodiments, the recoil reduction systems are incorporated into factory-supplied firearms.

Various embodiments of the disclosed recoil reduction system provide dual deformable elements, a first of the deformable elements adapted to absorb a first fraction of a total recoil deflection without displacing the hand of the operator, and a second of the deformable elements adapted to absorb a second fraction of the total recoil deflection that does displace the hand of the operator. In bifurcating the total recoil deflection in this way, a hand grip of the recoil reduction system may be dimensioned to accommodate an ordinary hand size while providing a gradual, less jarring recoil to the shoulder of the operator.

Some conventional sliding stock systems include a pistol or hand grip and are arranged so that the receiver recoils into the pistol grip. An advantage of such systems is that, over the compensated stroke of the recoil, the pistol grip does not recoil into the hand of the operator, thereby providing greater stability and control of the firearm. However, this arrangement limits the length of the compensation of the recoil because the stroke cannot exceed the longitudinal dimension (i.e., the dimension along the x-axis of FIG. 1) of the pistol grip. At some point, simply enlarging the longitudinal dimension of the pistol grip to provide more slide length therein is not a solution because the enlarged dimension would cause the pistol grip to be too big for gripping with a normal sized hand. Accordingly, these systems do not fully accommodate recoil events that exceed the limited stroke length of the system. When these sliding stock systems reach the maximum stroke length, the remaining kinetic energy generates an impact shock that is absorbed by the operator. As a result, these systems can still cause the pistol grip to kick back against the hand of the operator for high powered loads, as well as against the shoulder of the operator.

To compensate, such sliding stock systems may include a conventional butt pad in an effort to at least mitigate the impact shock against the shoulder of the operator. However, such remedy are historically of marginal utility. Conventional butt pads are typically made of a compliant or soft material having a hardness typically in the range of 30 to 70 Shore 00 hardness. Such butt pads yield freely during the initial phases of the impact shock, but may become compressed and unyielding before the recoil stroke of a recoil event is complete, so that the operator will still experience a sudden impact shock.

Various embodiments of the disclosure are directed to abatement of the recoil beyond the stroke length of the sliding stock. To this end, the recoil reduction system includes a biasing element and a butt pad assembly configured to deform substantially proportionate to each other during a recoil event. This draws out the fraction of the recoil compensated by the butt pad over a longer time period, so that the operator experiences a less abrupt buildup of recoil force imparted by the butt pad against the shoulder and the handgrip against the hand. So, while the butt pad and handgrip will translate backward into the operator, such translation is comparatively gradual in relation to the more violent shock impact generated by conventional sliding stock systems.

In some embodiments, the biasing element and/or butt pad assembly includes a spring-type element or, alternatively, a dampening device. The butt pad assembly may include an open cell butt pad having a hardness that is substantially higher than conventional butt pads. In some embodiments, the recoil reduction includes a buffer tube housed within a buttstock, and a deformable structure for setting a clearance tolerance between the buffer tube and the buttstock to reduce lateral play while enabling smooth translation therebetween. In some embodiments, a guide pin and/or skid projections provide interference between the sliding components of the recoil reduction system when in a battery position, while releasing the interference during a recoil event.

In some embodiments, favorable performance of the butt pad assembly is realized by material and structural characteristics that linearize the deflection of the butt pad assembly over the time period of the recoil event by promoting rotation of the internal structural elements as opposed to compression of the internal structural elements. A surprising result of this philosophy is the use of harder rather than softer materials for the butt pad, which favors rotation of structural elements over compressive deformation of the structural elements. Favorable structural characteristics can be characterized in several ways, including the type of structure (e.g., various polygonal structures, relationship between linkages within that structure), a porosity of such structures, and dimensionless characteristics of the open cell structures. Favorable combinations of hardness and structure of the butt pad assembly can be more generally characterized by spring constant, compressive displacement, and/or energy capacity. Favorable characteristics of the overall may be characterized in terms of the spring constants and energy capacity of both the butt pad assembly and the sliding stock, as well as a ratio of the compressive displacements of the sliding member to the butt pad assembly.

Structurally, a recoil reduction system is disclosed that includes a buttstock, a slide member for coupling to a receiver, a biasing element operatively coupled with the buttstock and the slide member, and a butt pad coupled to a proximal end of the buttstock. In one embodiment, the biasing element is configured for a compressive displacement that is at least 1.5 times and not more than 5 times a compressive displacement of the butt pad during a recoil event.

A butt pad for a buttstock of a firearm is also disclosed, the butt pad including a lattice structure defining an open cell structure that is exposed to ambient air, the lattice structure defining a plurality of primary polygonal structures including a combination of perpendicular linkages and canted linkages joined at junctions. In one embodiment, the butt pad is formed of a material having a Shore A hardness of at least 50 and not more than 70.

DETAILED DESCRIPTION

Figure 1:
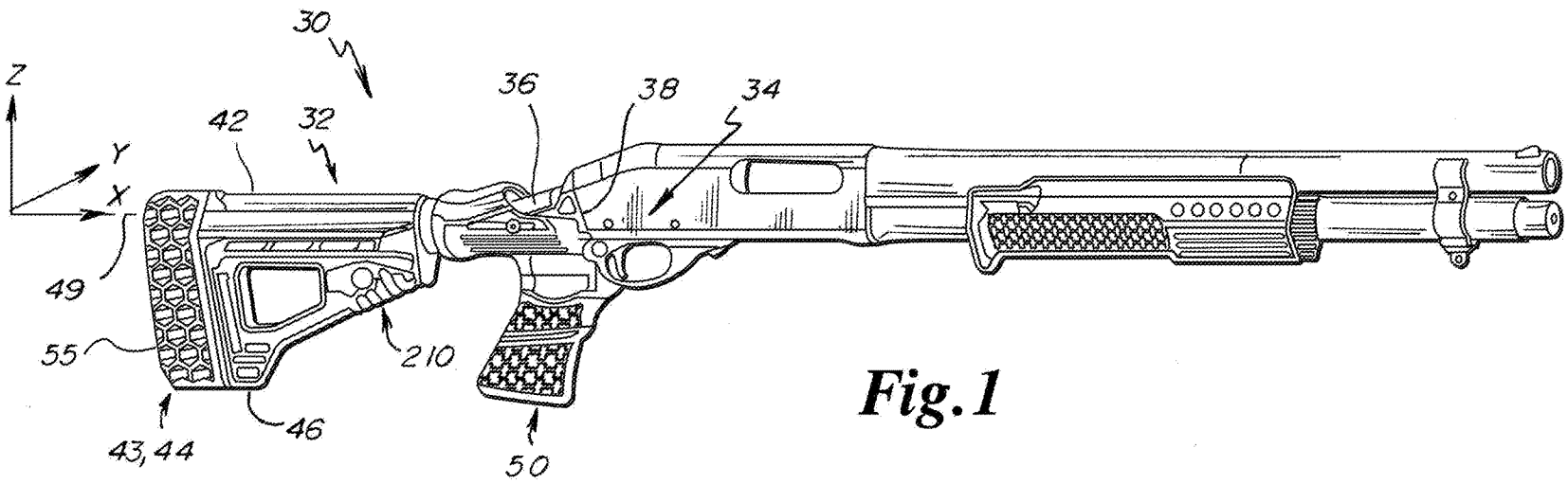
FIG. 1 is a perspective view of a modified firearm utilizing a recoil reduction system in an embodiment of the disclosure.

Referring to FIG. 1, a modified firearm 30 implementing a recoil reduction system 32 is depicted in an embodiment of the disclosure. The firearm 30 includes a receiver 34 of a standard firearm, for example a Remington Model 870™ Wingmaster® (depicted). The recoil reduction system 32 includes a slide member 36 having a front or distal end 38 configured for mounting to the specific receiver 34 and operatively coupled to a buttstock 42. A butt pad assembly 43 is operatively coupled to a rear or proximal end 46 of the buttstock 38. In various embodiments, the butt pad assembly 43 includes an open cell butt pad 44, as depicted in FIG. 1.

A biasing element 48 (FIG. 2) is operatively coupled with the slide member 36 and the buttstock 42 to exert a biasing force therebetween, thereby urging the slide member 36 forward relative the buttstock 42. In one embodiment, the recoil reduction system 32 includes a hand grip assembly 50 mounted to the buttstock 42, the slide member 36 extending into the hand grip assembly 50 and being translatable along an actuation axis 49. In one embodiment, the biasing element 48 is housed in the hand grip assembly 50.

Figure 2:
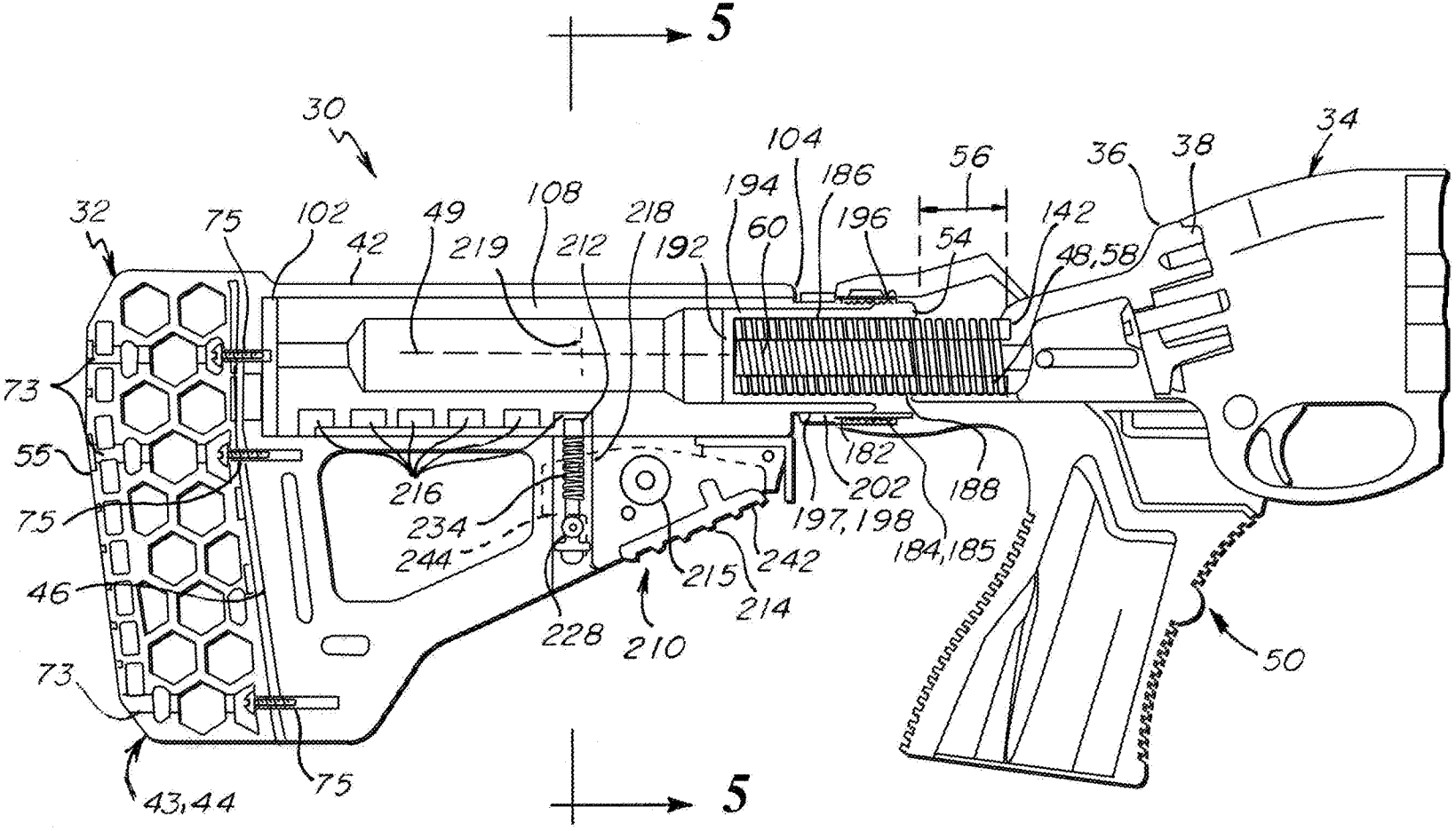
FIG. 2 is a sectional view of the recoil reduction system of FIG. 1 in a battery configuration in an embodiment of the disclosure.
Figure 3:
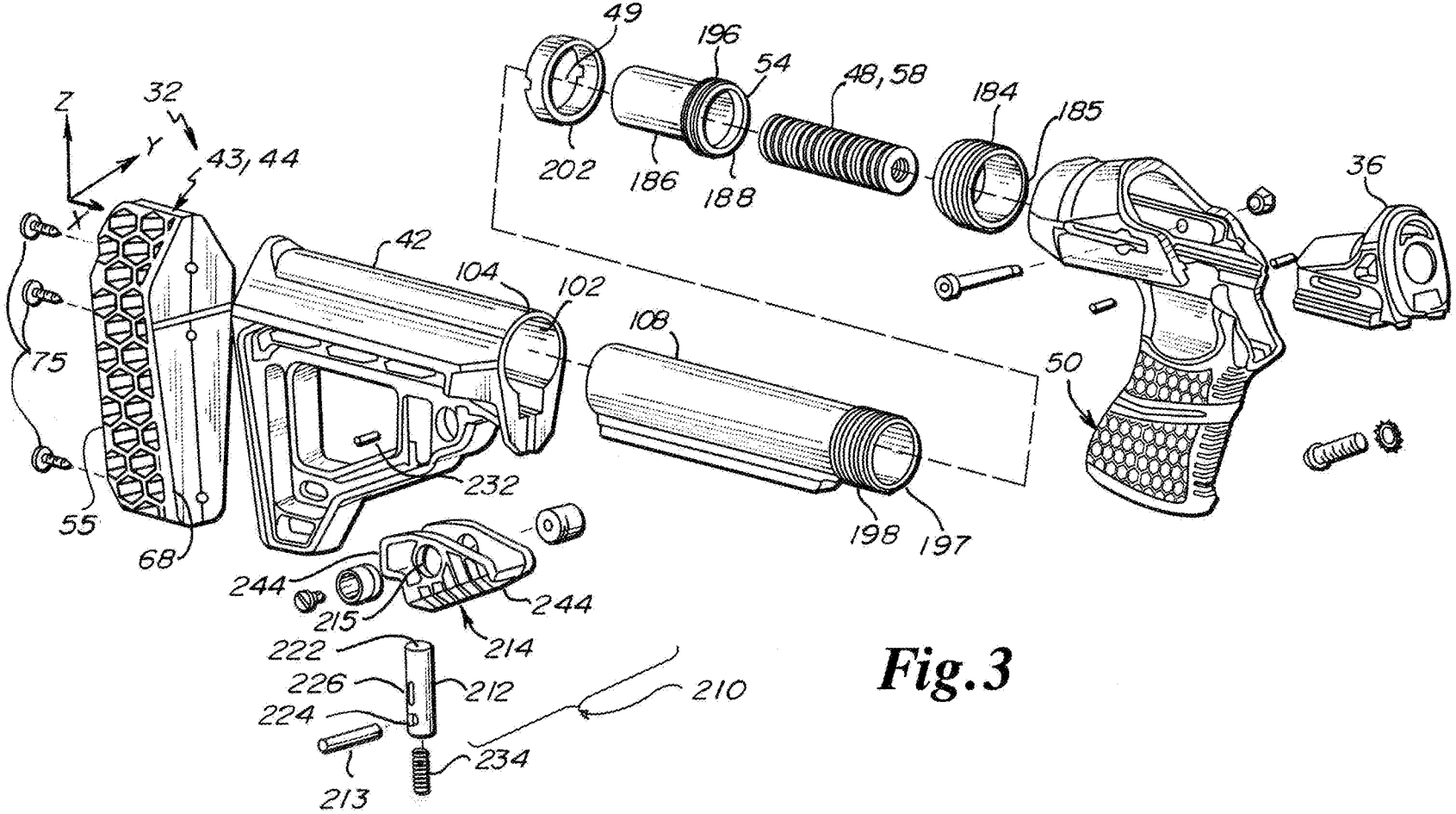
FIG. 3 is an exploded view of the recoil reduction system of FIG. 1 in an embodiment of the disclosure.

Referring to FIGS. 2 and 3, the recoil reduction system 32 is presented in an embodiment of the disclosure. In one embodiment, the recoil reduction system 32 includes a rearward or proximal stop 54 that limits the rearward or proximal travel of the slide member 36 relative to the buttstock 42 during firing of the modified firearm 30. (In the depicted embodiment, the proximal stop 54 is a distal end of a spring tube 186, described in greater detail below.) Herein, "proximal" refers to a relative direction or location that is towards a shouldered face 55 of the butt pad assembly 43, while "distal" refers to a relative direction or location that is away from the shouldered face 55.

A maximum bias member displacement 56 (FIG. 2) along the actuation axis 49 is thereby defined between the proximal stop 54 and the slide member 36 when in a battery configuration. In various embodiments, the biasing element 48 is configured for a substantially linear spring rate over the maximum bias member displacement 56. In various embodiments, the spring rate is in the range of 120 to 200 lbf/in inclusive. (Herein, a range that is said to be "inclusive" includes the end point values of the stated range, as well as the values between the end point values.) In some embodiments, the spring rate is in the range of 150 to 170 lbf/in inclusive.

In various embodiments, the biasing element 48 comprises a coiled spring 58. In some embodiments, the biasing element 48 also includes a second spring 60 nested within the coiled spring 58. By nesting springs in this manner, the springs act in parallel, providing a stiffer combined spring rate than either one of the springs 58, 60. In one non-limiting example, the coiled spring 58 is an ISO-204 die spring type having a spring rate of 25 N/mm and the second spring 60 is an ISO-203 die spring type having a spring rate of approximately 3.2 N/mm, for a combined spring rate of approximately 28 N/mm. Such springs are commercially available from, for example, Associated Spring Raymond of Maumee, Ohio, U.S.A. The coil spring(s) 58, 60 may be made of any suitable material available to the artisan, including carbon steel or a high resilience polymer. In other embodiments, the biasing element 48 includes some other suitably elastic member, such as a rubber cylinder (not depicted).

Figures 4, 4A, 4B:
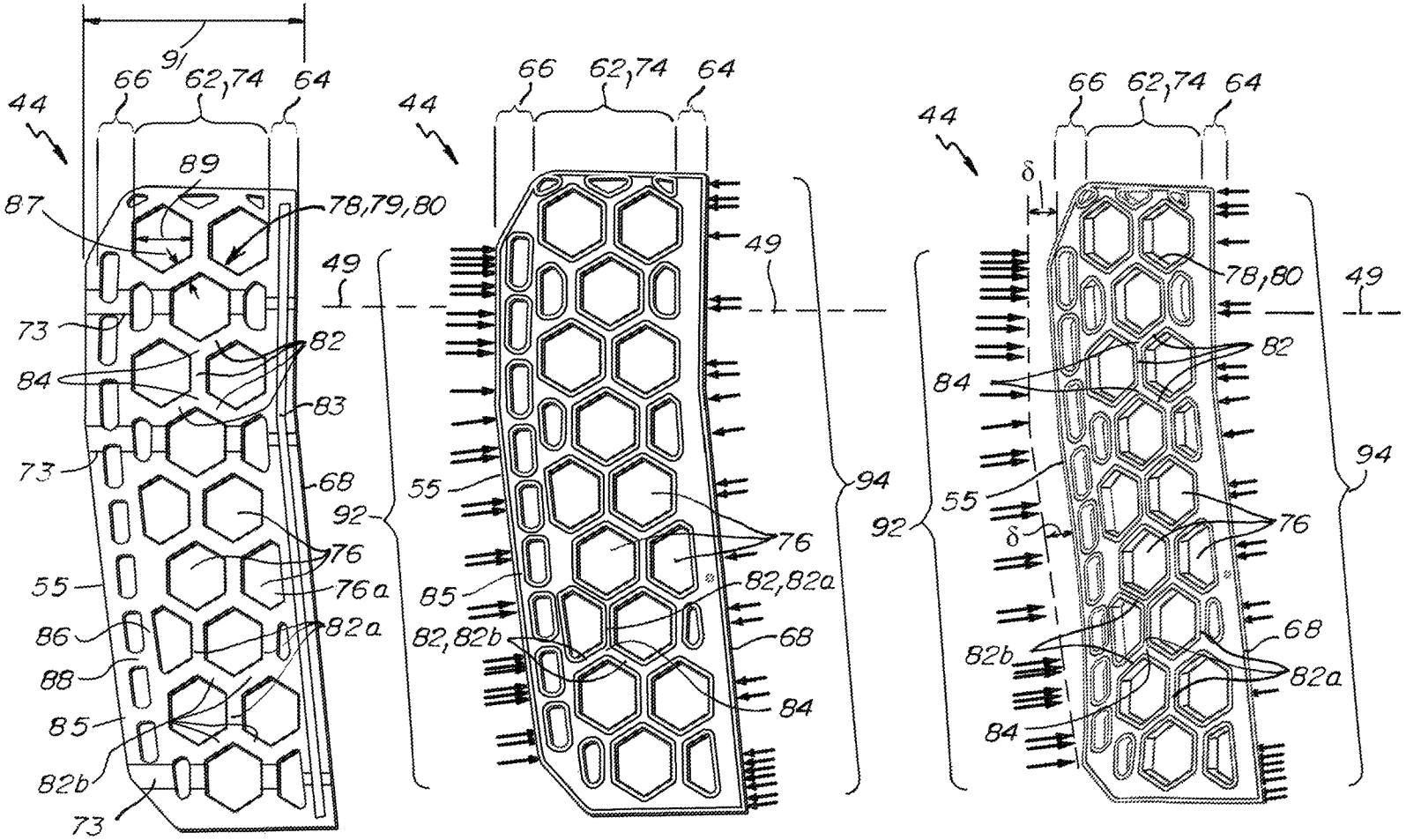
FIG. 4 is an elevation view of an open cell butt pad in an embodiment of the disclosure.
FIGS. 4A and 4B are elevation views of the open cell butt pad of FIG. 4 for a finite element analysis simulating a recoil event in an embodiment of the disclosure.

Referring to FIG. 4, the open cell butt pad 44 is depicted in isolation in an embodiment of the disclosure. In the depicted embodiment, the open cell butt pad 44 includes a core portion 62 that separates a mounting structure 64 and an end cap portion 66. The mounting structure 64 defines a distal face 68 of the open cell butt pad 44. The end cap portion 66 is disposed at the shouldered face 55 (proximal face) of the open cell butt pad 44 for registration against the shoulder or other anatomical component of an operator of the modified firearm 30. The open cell butt pad 44 may also define one or more access passages 73 to accommodate the passage of fasteners 75 (FIG. 2) for mounting of the open cell butt pad 44 to the buttstock 42.

The core portion 62 is an open cell structure 74 that defines a plurality of open cells 76 that are exposed to ambient air. That is, each of the open cells 76 of the open cell structure 74 is vented to ambient, for example by the absence of an exterior lateral skin, such that the open cell structure 74 defines a plurality of through-holes. In various embodiments, the open cells 76 extend laterally through the core portion 62 ("lateral" meaning parallel to any plane that is normal to the actuation axis 49).

The open cell butt pad 44 can be characterized as having a porosity or void fraction, defined as the ratio of the volume of the air that occupies the open cells 76 of the open cell butt pad 44 to the total volume of the open cell butt pad 44. In various embodiments, the porosity is in the range of 86% to 90% inclusive. In some embodiments, the porosity is in the range of 85% to 92% inclusive. In still other embodiments, the porosity is in the range of 80% to 95% inclusive.

In various embodiments, the open cell structure is defined by a lattice structure 78. The lattice structure 78 can be characterized as a network of linkages 82 joined at junctions 84, the linkages 82 and junctions 84 being unitary. In some embodiments, the lattice structure 78 defines a "honeycomb" structure 79, i.e., where the open cells 76 define at least part of a primary polygonal structure, as depicted in FIG. 4A. That is, some passages fully define the primary polygonal structure, while others, being interrupted by the boundaries of the open cell butt pad 44, form only a portion of the primary polygonal structure (e.g., open cell 76*a* of FIG. 4). In the depicted embodiment, the primary polygonal structure of the open cells 76 of the honeycomb structure 79 is a hexagonal structure 80. Other polygonal structures include triangular, diamond-shaped, pentagons, and octagons. In various embodiments, the lattice structure 78 is formed of a material having a Shore A hardness in the range of 55 to 65 inclusive. In some embodiments, the Shore A hardness is in the range of 50 to 70 inclusive. In still other embodiments, the Shore A hardness is in the range of 50 to 80 inclusive.

The mounting structure 64 of the open cell butt pad 44 may be profiled to complement the proximal end 46 of the buttstock 42. In one embodiment, the mounting structure 64 includes a plate 83 that is substantially rigid relative to the material of the open cell butt pad 44. The end cap portion 66 may be unitary or integrally formed with the lattice structure 78 of the core portion 62. In one embodiment, the end cap portion 66 includes a proximal plate portion 85 and a distal plate portion 86 separated by a plurality of web portions 88, the plate portions 85, 86 and web portions 88 being of the same material and hardness as the core portion 62.

For the hexagonal structure 80 of the depicted open cell butt pad 44, the linkages 82 fall into two general categories: perpendicular linkages 82*a*, which extend substantially perpendicular to the actuation axis 49 between junctions 84; and canted linkages 82*b*, which extend at acute angles relative to the actuation axis 49 between junctions 84. A third category of linkages are parallel linkages that extend substantially parallel to the actuation axis 49. While the hexagonal structure 80 does not provide examples of parallel linkages, the web portions 88 approximate such parallel linkages between the proximal and distal plate portions 84 and 86.

In certain embodiments, the primary polygonal structure of the open cells 76 of the lattice structure 78 define an internal dimension 89 in the longitudinal directions of the primary polygonal structure that is nominally 0.47 inches. In various embodiments, the internal dimension 89 is in a range of 0.45 inches to 0.5 inches inclusive; in some embodiments, in a range of 0.4 inches to 0.55 inches inclusive. In some embodiments, a nominal thickness 87 of the linkages 82 that define the primary polygonal structure is nominally 0.125 inches. In some embodiments, the nominal thickness 87 is in a range of 0.1 inches to 0.15 inches inclusive; in some embodiments, in a range of 0.063 inches to 0.188 inches inclusive; in some embodiments, in a range of 0.032 inches to 0.25 inches inclusive.

In various embodiments, open cells 76 of the lattice structure 78 can be characterized dimensionlessly by a void-to-thickness ratio, defined as the ratio of the internal dimension 89 in the longitudinal directions of the primary polygonal structure to the nominal thickness 87 of the linkages 82 that define the primary polygonal structure. In some embodiments, the void-to-thickness ratio is in the range of 3.0 to 4.5 inclusive; in some embodiments, in the range of 3.5 to 4.0 inclusive; in some embodiments, in the range of 3.7 to 3.8 inclusive.

In some embodiments, the open cells 76 can be characterized dimensionlessly as a length-to-void ratio, defined as the ratio of the a maximum length thickness 91 of the open cell butt pad 44 in the longitudinal directions to the internal dimension 87 in the longitudinal directions of the primary polygonal structure. In some embodiments, the length-to-void ratio is in the range of 2.5 to 4.5 inclusive; in some embodiments, in the range of 3.0 to 4.0 inclusive; in some embodiments, in a range of 3.3 to 3.7 inclusive; in some embodiments, in the range of 3.4 to 3.6 inclusive.

Referring to FIGS. 4A and 4B, depictions of the open cell butt pad 44 in operation are presented in an uncompressed and a partially compressed state, respectively, in an embodiment of the disclosure. The depictions of FIGS. 4A and 4B visually represent the results of a finite element analysis (FEA) model. A proximal boundary condition 92 emulating the interaction of an operator is imposed on the shouldered face or proximal face 55 of the end cap portion 66, and a distal boundary condition 94 emulating coupling with the buttstock 42 is imposed on the distal face 68 of the open cell butt pad 44. For the depicted embodiment, the open cells 76 of the open cell structure 74 extend side-to-side (i.e., parallel to the y-axis of FIG. 1). It is noted that the open cells 76 may extend in any direction lateral to the actuation axis 49 with similar effect (i.e., in any direction parallel to the y-z plane of FIG. 1).

For the FEA analysis, arbitrary force of 10 N was modeled to create a deformation profile. For illustrative purposes, the deformations were amplified 100-fold to arrive at the depiction of FIG. 4B. While some bending deformation of the linkages 82 is evident, the primary mode of the overall deformation of the hexagonal structure 80 is rotation of the linkages 82 about the junctions 84 of the lattice structure 78. Most of the perpendicular linkages 82*a* remain substantially perpendicular, with exceptions being those linkages 82*a* aligned with the discontinuity of the proximal boundary condition 92 relative to the distal boundary condition 94. The canted linkages 82*b* rotate substantially about their respective junctions 84.

Functionally, the effect is to produce an elongation of the open cells 76 of the hexagonal structure 80 in a lateral direction. In this way, the open cell butt pad 44 undergoes a nominal compression 6 (FIG. 4B) without substantial compression of the material that comprises the lattice structure 78. The rotation of the linkages and elongation of the open cells mitigates the non-linearity and attendant shock abruptness of the compressible materials of certain conventional butt pads.

As a system, when the modified firearm 30 is fired, the receiver 34 and slide member 36 recoil to produce simultaneous deformations of the biasing element 48 and the butt pad assembly 43, wherein the deformation of the biasing element 48 and the butt pad assembly 43 are substantially proportionate to each other throughout a recoil event. Herein, a "recoil event" is a recoil of the recoil reduction system caused by discharge of the connected firearm. The recoil event is further characterized as having a "recoil stroke" during which the biasing element 48 and the butt pad assembly 43 undergo increasing compression from a battery configuration to a maximum compressed state for the recoil stroke, and a "return stroke" during which the biasing element 48 and the butt pad assembly 43 undergo increasing expansion from the a maximum compressed state in returning to the battery configuration.

By maintaining the linearity of the compression of the butt pad 44 (or more generally, the butt pad assembly 43) throughout the recoil event, the recoil force imparted by the butt pad against the shoulder and by the handgrip against the hand extended over the entire time interval of the recoil stroke of the recoil event, as opposed to a more abrupt recoil force that is experienced by compression and subsequent structural collapse of softer, conventional butt pads.

In operation, during a recoil event, the slide member 36 is thrust against the biasing element 48 which exerts a recoil force against the buttstock 42. Typical and non-limiting impulse forces generated by conventional firearms range from 500 N to 2500 N (112 lbf to 560 lbf). Some of the recoil force is absorbed by (i.e., causes deformation of) the biasing element 48, whereas some of the recoil force is absorbed by the open cell butt pad 44. The deformation of the biasing element 48 and the open cell butt pad 44 can each be characterized in terms of compressive displacement parallel to the actuation axis 49. In various embodiments, the biasing element 48 is adapted for a compressive displacement that is at least 1.5 times and not more than 5 times a compressive displacement of the open cell butt pad 44 during firing of the modified firearm 30. In one embodiment, the biasing element 48 is adapted for a compressive displacement that is at least 2 times and not more than 4 times a compressive displacement of the open cell butt pad 44 during firing of the modified firearm 30. In one embodiment, the open cell butt pad 44 is adapted for a compressive displacement that is at least 8 mm and not more than 20 mm.

The biasing element 48 and the open cell butt pad 44 can also be characterized in terms of their respective spring rates. That is, biasing element 48 can be said to have a first spring rate, and the open cell butt pad 44 can be said to have a second spring rate. Herein, a "spring rate," also known as a "spring constant," of a component is defined by a ratio of the force to the compressive displacement of the component caused by application of that force, in accordance with Hooke's law.

In still other embodiments, one or both of the biasing element 48 and the open cell butt pad 44 is a dampening device (not depicted), such as a hydraulic damper or a pneumatic damper. Dampening devices are generally not characterized in terms of a spring rate, but rather in terms of an "energy capacity," having units of energy (e.g., joules or ft-lbf). A compressive displacement of such dampening devices during a recoil event can be calculated, such that the dampening device is sized to provide a desired compressive displacement. Herein, a "compressive displacement" is the change in length of a compressed component, such as the biasing member 48 or the open cell butt pad 44, in a direction parallel to the actuation axis 49 of the respective component during a recoil event. In various embodiments, the biasing element 48 is a dampening device having an energy capacity in the range of 30 to 100 Joules inclusive to provide a compressive displacement in the range of approximately 10 to 30 mm, depending on the impulse force.

The butt pad assembly 43 is not limited to the open cell butt pad 44. That is, a "butt pad" is a generic term for any structure that is affixed to the proximal end 46 of the buttstock 42. Alternative butt pads to the open cell butt pad 44 include, but are not limited to, coil-spring loaded plates and gel cores. Such alternative butt pads may be engineered to possess the displacement characteristics of the open cell butt pad 44 and to work in cooperation with the biasing element 48 to provide the same recoil effect as the disclosed embodiments.

In the depicted embodiment, the buttstock 42 defines a longitudinal bore 102 that extends along the actuation axis 49 and is accessible from a distal end 104 (FIG. 2) of the buttstock 42. In the depicted embodiment, a buffer tube 108 is disposed within the longitudinal bore 102. Herein, "longitudinal" is defined as being in a direction that is parallel to the actuation axis 49, whereas "lateral" is defined as being in any direction that is perpendicular to the actuation axis 49.

In further reference to FIGS. 2 and 3, the hand grip assembly 50 further defines a rearward opening 182. In one embodiment, a threaded insert 184 including internal threads 185 is molded into the rearward opening 182 of the hand grip assembly 50. In one embodiment, a spring tube 186 is disposed in the threaded insert 184, the spring tube 186 having an open forward end 188 and a bearing structure 192 at a rearward end 194. The bearing structure 192 may be, for example, an internal lip or flange, or a bridging structure such as a closed end (as depicted) or one or more laterally-extending rods. In the depicted embodiment, the forward end 188 includes exterior threads 196 that threadably engage with the threaded insert 184. The biasing element 48 is disposed in the spring tube 186 and extends into the rearward portion of the hand grip assembly 50, the biasing element 48 engaging both the bearing structure 192 of the spring tube 186 and a rearward face 142 of the slide member 36.

A front end portion 197 of the buffer tube 108 includes external threads 198 that mate with the internal threads 185 of the threaded insert 184 of the hand grip assembly 50. A castle nut 202 also engages the external threads 198 of the buffer tube 108, so that, when tightened against the hand grip assembly 50, the castle nut 202 imparts an axial load between the external threads 198 of the buffer tube 108 and the internal threads 185 of the threaded insert 184. During assembly, a bonding paste, such as LOCTITE®, may be applied between the external threads 198 of the buffer tube 108 and the internal threads 185 of the threaded insert 184. The bonding paste and the axial force exerted by the castle nut 202 act to resist rotation between the buffer tube 108 and the hand grip assembly 50.

Figure 5:
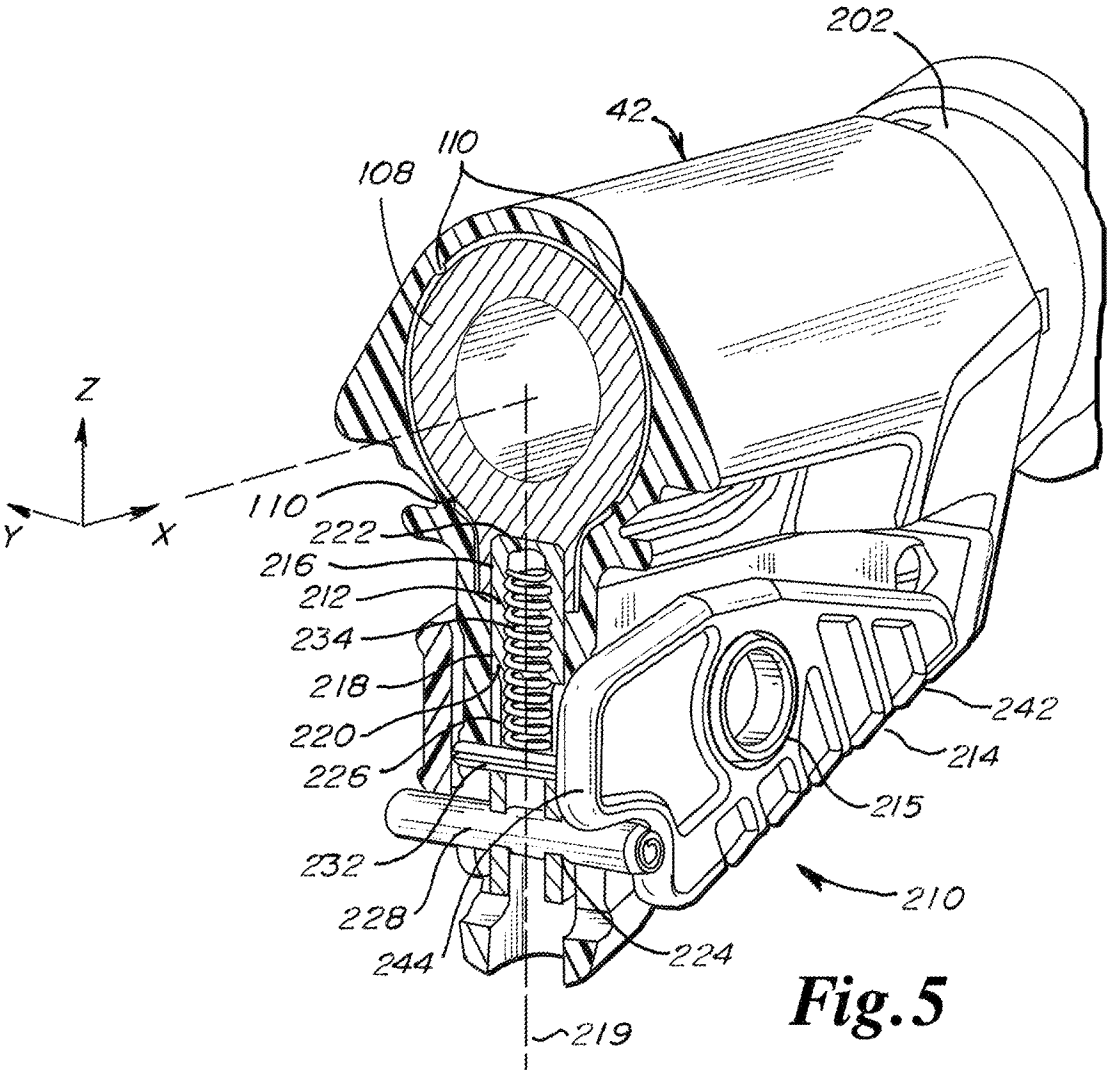
FIG. 5 is a partial sectional view of a stock length adjustment mechanism in an unactuated state in an embodiment of the disclosure.

Referring to FIG. 5 and again to FIGS. 2 and 3, a stock length adjustment mechanism 210 for the recoil reduction system 32 is depicted in an embodiment of the disclosure. The stock length adjustment mechanism includes an adjustment pin 212, an adjustment lever 214 coupled to the buttstock 42 about a pivot 215, and a plurality of adjustment notches 216 (FIG. 2) formed on the buffer tube 108. Portions of the adjustment lever 214 are outlined in FIG. 2 in phantom. In one embodiment, the adjustment pin 212 is housed within a bore 218 defined in the buttstock 42, the bore 218 defining a pin actuation axis 219 that is parallel to the z-axis. The adjustment pin 212 and bore 218 are dimensioned so that the adjustment pin 212 can slide within the bore 218. In various embodiments, the adjustment pin 212 comprises a hollow tube 220 with a closed or restricted diameter end portion 222. The hollow tube 220 may define a circular through hole 224 and a slotted through hole 226.

In various embodiments, a cross pin 228 is disposed in the circular hole 224 of the adjustment pin 212, the cross pin 228 extending parallel to the y-axis. In some embodiments, an anchor pin 232 extends across the bore 218 and through the slotted through hole 226, the anchor pin 232 being perpendicular to the pin actuation axis 219 and oriented in a direction parallel to the y-axis. The anchor pin 232 is secured on both ends to the buttstock 42. In the depicted embodiment, as spring 234 is disposed in the hollow tube 220, captured between the end portion 222 and the anchor pin 232.

In the depicted embodiment, the bore 218 is aligned with a selected one of the plurality of adjustment notches 216, such that the adjustment pin 212 extends out of the bore 218 and into selected notch 216. In FIG. 2, the adjustment pin 212 is in the forward-most of the adjustment notches 216, so that the effective length of the recoil reduction system 32 is at its shortest.

In operation, to change the length adjustment of the recoil reduction system 32, a forward end 242 of the adjustment lever 214 is pressed toward the buttstock 42, causing the lever 214 to rotate about pivot 215 so that a rearward end 244 of the lever rotates away from the buttstock 42. The rotation causes the rearward end 244 of the adjustment lever 214 exerts a force on the cross pin 228 which transfers to the adjustment pin 212, so that the adjustment pin 212 becomes dislodged from the adjustment notch 216. With the adjustment pin 212 dislodged from the adjustment notch 216, the buffer tube 108 may be slid longitudinally within the bore 102 of the buttstock 42 to establish a different overall length of the recoil reduction system 32.

During actuation of the adjustment pin 212, the slotted through hole 226 slides over the stationary anchor pin 232 as the end portion 222 is drawn closer to the anchor pin 232. The spring 234 becomes compressed between the end portion 222 and the anchor pin 232. The compression biases the adjustment pin 212 so that, upon release of the adjustment lever 214, the adjustment pin 212 is urged back into contact with the buffer tube 108 and, perhaps after some additional positioning of the buffer tube 108 within the bore 102, into one of the adjustment notches 216.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims for the embodiments of the inventions, it is expressly intended that the provisions of 35 U.S.C. 112(f) are not to be invoked unless the specific terms "means for" or "step for" are recited in the respective claim.

What is claimed is:

1. A butt pad for a buttstock of a firearm, said butt pad comprising a lattice structure defining an open cell structure that is exposed to ambient air, said lattice structure defining a plurality of primary polygonal structures including a combination of perpendicular linkages and canted linkages joined at junctions, wherein said butt pad is formed of a material having a Shore A hardness of at least 50 and not more than 70.

2. The butt pad of claim 1, wherein:

said primary polygonal structure defines a nominal internal length dimension in a direction parallel to an actuation axis of said firearm;

said perpendicular linkages and said canted linkages each define a nominal thickness; and a ratio of said nominal internal length dimension to said nominal thickness is in a range of 3 to 4.5 inclusive.

3. The butt pad of claim 2, wherein said ratio is in a range of 3.7 to 3.8 inclusive.

4. The butt pad of claim 1, wherein:

said butt pad defines a maximum length thickness in a direction parallel to an actuation axis of said firearm;

said primary polygonal structure defines a nominal internal length dimension in a direction parallel to an actuation axis of said firearm; and a ratio of said maximum length thickness to said nominal internal length dimension is in a range of 2.5 to 4.5 inclusive.

5. The butt pad of claim 4, wherein said ratio is in a range of 3.3 to 3.7 inclusive.

6. The butt pad of claim 1, wherein said lattice structure defines a porosity of at least 85% and not more than 92%.

7. The butt pad of claim 1, wherein said primary polygonal structure is a hexagonal structure.

8. The butt pad of claim 7, wherein said primary polygonal structure defines a nominal internal length dimension in a direction parallel to an actuation axis of said firearm, said nominal internal length dimension being in a range of 0.4 inches to 0.55 inches inclusive.

9. The butt pad of claim 8, wherein said nominal internal length dimension is in a range of 0.1 inches to 0.15 inches inclusive.

10. The butt pad of claim 8, wherein said perpendicular linkages and said canted linkages each define a nominal thickness in a range of 0.032 inches to 0.25 inches inclusive.

11. The butt pad of claim 10, wherein said perpendicular linkages and said canted linkages each define a nominal thickness in a range of 0.1 inches to 0.15 inches inclusive.

* * * * *